US008080754B2

(12) United States Patent
Ono

(10) Patent No.: US 8,080,754 B2
(45) Date of Patent: Dec. 20, 2011

(54) PUSH SWITCH

(75) Inventor: Koji Ono, Okayama (JP)

(73) Assignee: Panasonic Corporation, Osaka (JP)

( * ) Notice: Subject to any disclaimer, the term of this patent is extended or adjusted under 35 U.S.C. 154(b) by 347 days.

(21) Appl. No.: 12/233,765

(22) Filed: Sep. 19, 2008

(65) Prior Publication Data

US 2009/0107821 A1 Apr. 30, 2009

(30) Foreign Application Priority Data

Oct. 29, 2007 (JP) ..... 2007-279879

(51) Int. Cl.
*H01H 13/70* (2006.01)

(52) U.S. Cl. ..... 200/344; 200/345

(58) Field of Classification Search ..... 200/344, 200/345, 518, 519, 534, 535
See application file for complete search history.

(56) References Cited

U.S. PATENT DOCUMENTS 5,345,051 A * 9/1994 Miike ..... 200/345
5,545,866 A * 8/1996 Bulin et al. ..... 200/345
5,895,901 A * 4/1999 Watanabe et al. ..... 200/534
6,107,586 A * 8/2000 Takeuchi et al. ..... 200/535
6,204,462 B1 * 3/2001 Huang ..... 200/345
6,271,487 B1 8/2001 Domzalski et al.

FOREIGN PATENT DOCUMENTS

CN 2415447 Y 1/2001
CN 200810172088.X 10/2010
JP 4-111119 U 9/1992

* cited by examiner

*Primary Examiner* — Elvin G Enad
*Assistant Examiner* — Lisa Klaus
(74) *Attorney, Agent, or Firm* — RatnerPrestia

(57) ABSTRACT

A push switch includes a housing having a top opening and a recessed section at a lower part, a push-type switch contact placed on an inner bottom face of the recessed section, an operating unit having an operating section at an upper part and a flange section at a lower part, a resilient unit placed under the operating unit in the recessed section for energizing the operating unit upward, and a cover for covering the top opening and having a center hole from which the operating section extends upward. The operating unit is movable vertically guided by a guide projection placed on inner walls confronting each other of the recessed section and extending vertically and by a concave section formed on the flange section for mating with the guide projection. The operating section includes faces vertically rising from the positions where the concave sections are recessed most inward.

12 Claims, 9 Drawing Sheets

PUSH SWITCH

FIELD OF THE INVENTION

The present invention relates to a push switch to be used as one of operating sections of a variety of electronic devices.

BACKGROUND OF THE INVENTION

In recent years, a push switch which needs a long stroke has been preferred as an operating section of electronic devices, e.g. a car air-conditioner, car audio device, and other audio-visual devices, because those devices need lighting and a higher density at their operating panels.

Such a conventional push switch as discussed above is described hereinafter with reference to FIG. 8 and FIG. 9. FIG. 8 shows an exploded perspective view of the conventional push switch, and FIG. 9 shows a sectional view cut along line 9-9 in FIG. 8. Box-shaped housing 1 shown in FIG. 8 is open at its top and made of insulating resin, and its recessed section forms typically a cubic space. A pair of fixed contacts 2 is rigidly mounted to the center of the inner bottom face of the recessed section. Fixed contacts 2 are made of well-conductive metal plate and stay bared by insert-molding. Each one of fixed contacts 2 extends outward from the side wall of housing 1, and each one of the extended tips forms terminal 7.

Resilient unit 3 is shaped like a cone open at its bottom and made of silicone rubber. It is placed on the inner bottom face of housing 1, and includes well-conductive movable contact 4 placed on the underside of the ceiling within the cone shape. The lower perimeter of resilient unit 3 is positioned by retainers 1A provided at lower sections on the inner wall of housing 1.

Operating unit 5 made of insulating resin is formed of square-shaped plane section 5A, legs 5B depending from each one of the four corners of plane section 5A, and projections 5C projecting laterally from the lower end of legs 5B. Plane section 5A is seated on a flat top face of resilient unit 3.

Cover 6 made of thin metal plate includes rectangular hole 6A at its center, and is mounted to housing 1 such that plane section 5A of operating unit 5 protrudes from rectangular hole 6A. The top opening of housing 1 is covered with a flat portion around rectangular hole 6A.

Each one of legs 5B of operating unit 5 is placed correspondingly to each one of the four corners of the recessed section of housing 1. Each one of the four corners forms guide bore 1B which is formed by inner faces of adjacent two walls of housing 1 and lateral walls of each one of retainers 1A. When operating unit 5 moves downward, projection 5C projected from the lower end of leg 5B is guided along guide bore 1B.

Plane section 5A of operating unit 5 of the push switch discussed above is depressed, then projection 5C of leg 5B lowers along guide bore 1B provided at the inside corner of housing 1 while the perimeter of plane section 5A is regulated by rectangular hole 6A. This lowering prompts plane section 5A to push resilient unit 3 downward, and when operating unit 5 is depressed by a given stroke, a flaring section forming the cone shape of resilient unit 3 is deformed resiliently with tactile feeling, so that movable contact 4 placed on the underside of the ceiling within resilient unit 3 is brought into contact with the pair of fixed contacts 2, namely, the push switch is turned ON.

A removal of depressing force from operating unit 5 prompts the flaring section, deformed resiliently, of resilient unit 3 to restore itself to its original position due to its own restoring force. Operating unit 5 is thus pushed back and movable contact 4 leaves fixed contacts 2, and the push switch returns to OFF status again. At this time operating unit 5 returns to its original position as shown in FIG. 9 with its foregoing respective sections being regulated.

Related art to the present invention is disclosed in, e.g. Japanese Utility Model Unexamined Publication No. H04-111119.

Since the conventional push switch discussed above meets a long stroke requirement and is excellent in operation, it has been used in a large number of devices. However, this conventional push switch has often invited requirements of downsizing and a slimmer body because of the market trend in which downsizing of the devices has been in progress and a higher density of mounting the components also has been in progress. During the operation of this push switch, its projection 5C projecting laterally from the lower end of leg 5B moves along guide bore 1B while the perimeter of plane section 5A, i.e. an upper part of operating unit 5, is regulated by rectangular hole 6A of cover 6. Since operating unit 5 moves up and down in the foregoing mechanism, given clearances are needed between the respective elements.

The climate of favoring the downsizing of the devices makes it difficult to greatly reduce the foregoing clearances necessary for maintaining the smooth up and down movement of operating unit 5. In particular, an employment of a downsized structure and a slimmer body with the conventional structure maintained will produce a difference in distances between the center and peripherals of operating unit 5 supported by resilient unit 3. When operating unit 5 is depressed at a place slightly shifted along the longitudinal direction due to an error produced by a combination of operating buttons with each other, the short side nearer to the shifted depression place tends to move downward, i.e. the short side tends to be jammed, which needs to be overcome.

SUMMARY OF THE INVENTION

The present invention addresses the problem discussed above, and aims to provide a push switch comprising the following elements for overcoming the problem:

a housing including an opening at its top and having a recessed section at its lower part;

a push-type switch contact placed on an inner bottom face of the recessed section;

an operating unit including an operating section at its upper part and a flange section at its lower part;

a resilient unit, disposed under the operating unit placed in the recessed section, for energizing the operating unit upward; and a cover for covering the opening of the housing and including a center hole from which the operating section extends upward.

The operating unit is movable up and down guided by guide projections extending vertically on the inner walls confronting each other of the recessed section and by concave sections provided to the flange section such that the concave sections mate with the guide projections. On top of that, the operating section includes a vertical face rising from the inner most recessed section of the concave section.

The foregoing structure, including a case where an outward appearance of the push switch shows a slimmer rectangular parallelepiped, allows providing the push switch of which operating unit resists being jammed.

DETAILED DESCRIPTION OF PREFERRED EMBODIMENT

An exemplary embodiment of the present invention is demonstrated hereinafter with reference to the accompanying drawings.

Exemplary Embodiment

Figure 1:
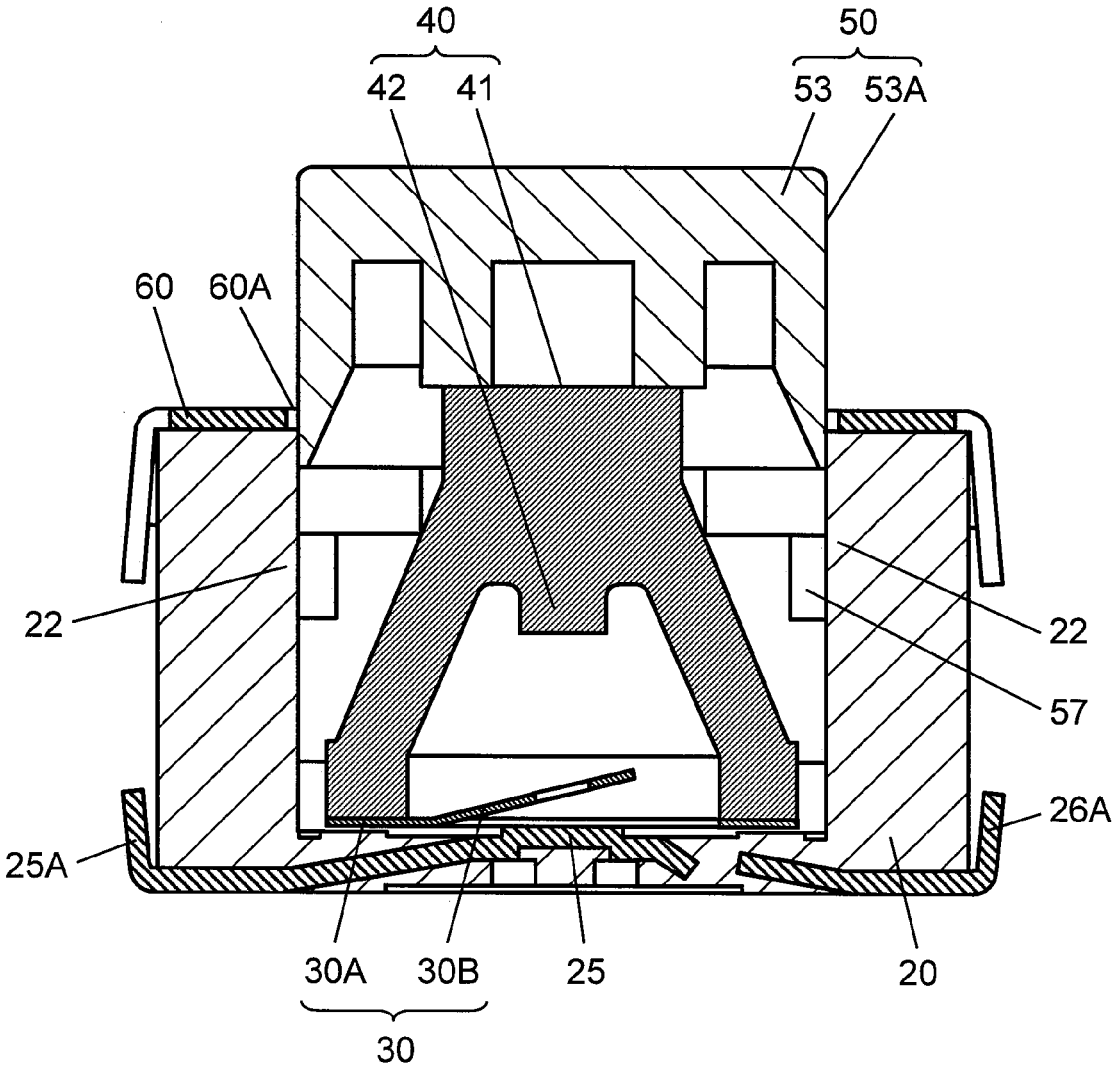
FIG. 1 shows a sectional view of a push switch in accordance with an embodiment of the present invention.
Figure 2:
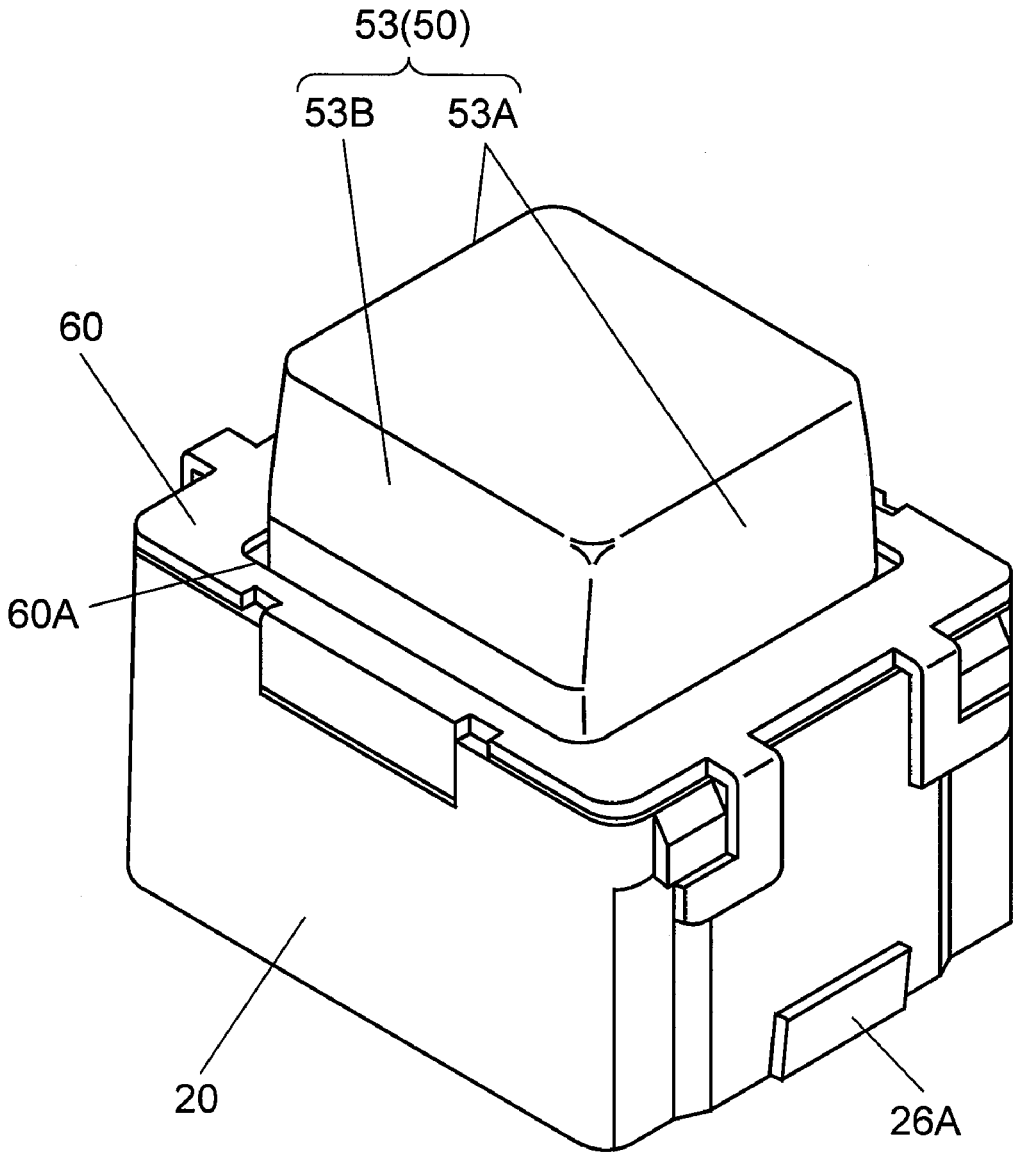
FIG. 2 shows a perspective view of an appearance of the push switch shown in FIG. 1.
Figure 3:
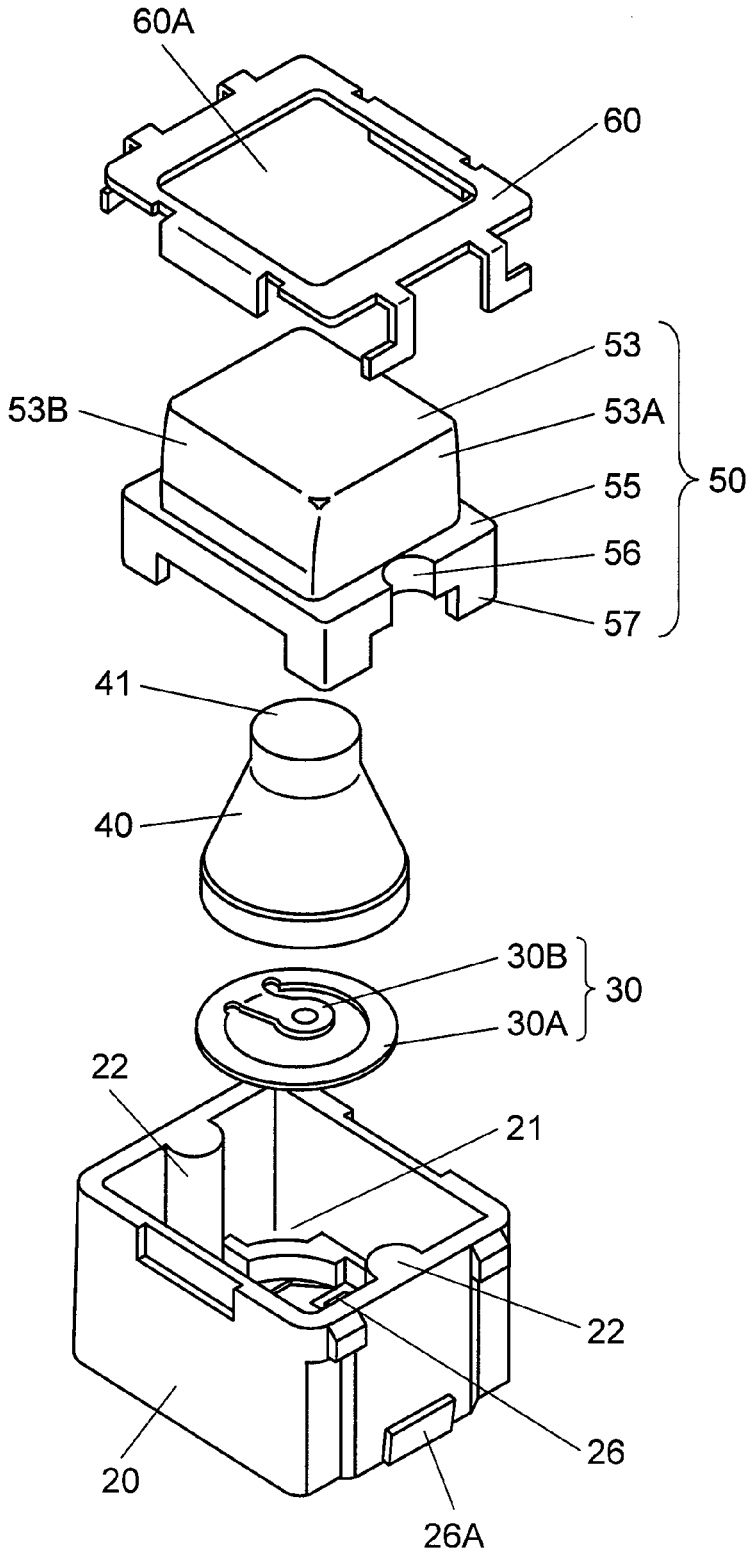
FIG. 3 shows an exploded perspective view of the push switch shown in FIG. 1.
Figure 4:
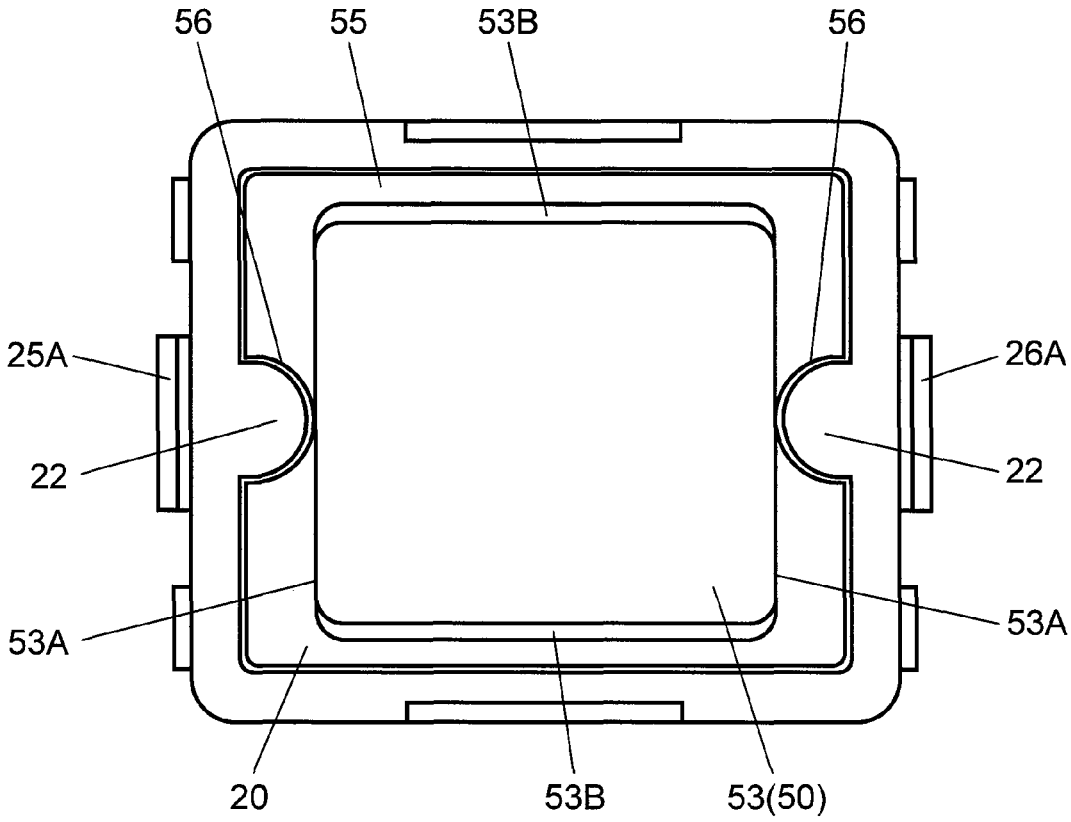
FIG. 4 shows a top view of the push switch shown in FIG. 1 with its cover removed.
Figure 5:
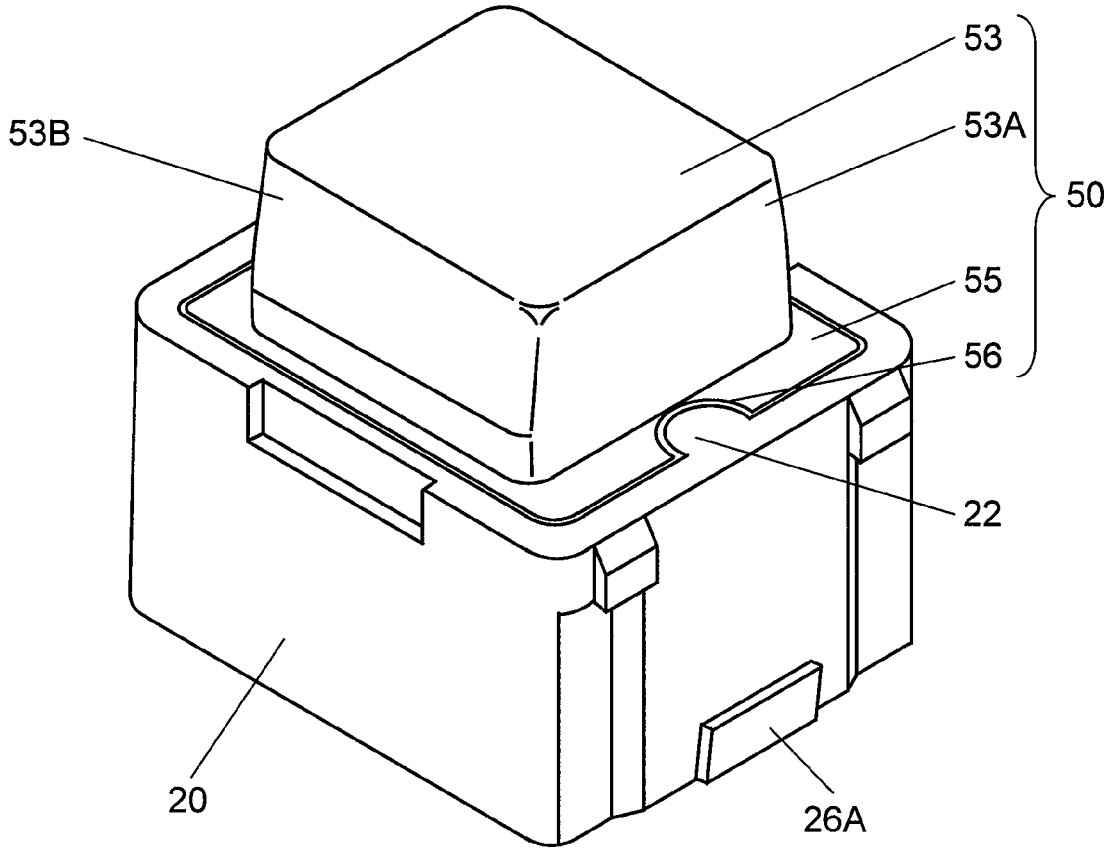
FIG. 5 shows a perspective view of an appearance of the push switch shown in FIG. 1 with its cover removed.
Figure 6:
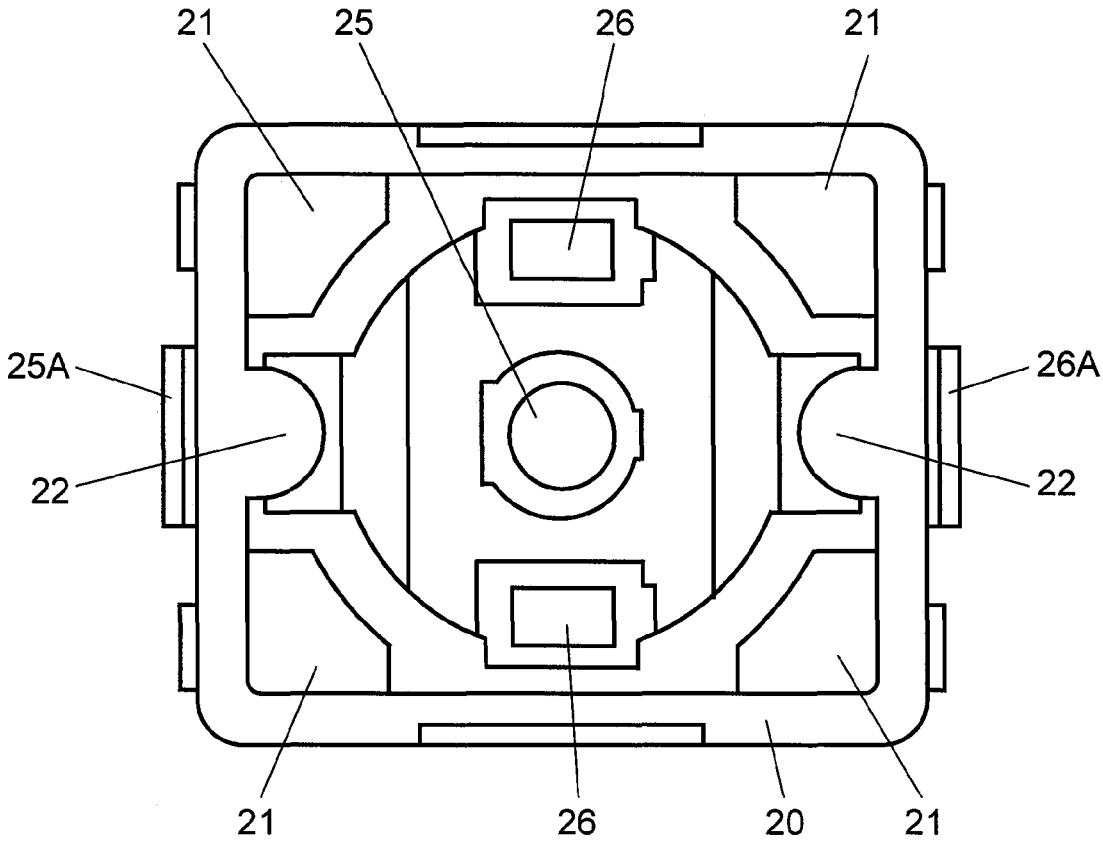
FIG. 6 shows a top view of a housing of the push switch shown in FIG. 1.

FIG. 1 shows a sectional view of a push switch in accordance with an embodiment of the present invention. FIG. 2 shows a perspective view of an appearance of the push switch. FIG. 3 shows an exploded perspective view of the push switch. FIG. 4 shows a top view of the push switch shown with its cover removed. FIG. 5 shows a perspective view of an appearance of the push switch with its cover removed. FIG. 6 shows a top view of a housing of the push switch.

In the foregoing drawings, housing 20 made of resin is shaped like a box with its top face opened. Housing 20 has an appearance of typically a rectangular parallelepiped and the space inside its recessed section also forms typically a rectangular parallelepiped. As shown in FIG. 6, center contact 25 and outside contact 26 are fixed to the inner bottom face of the recessed section. Contacts 25 and 26 have terminals 25A and 26A extending outside from housing 20.

Short sides viewed from a top of housing 20 include inner walls confronting each other, and each one of these confronting inner walls has guide projection 22 having an identical shape to each other and extending vertically from the top end thereof. A horizontal cross section of guide projection 22 shows like an arc typically in a semi-circle of which most inwardly projected section is positioned at the center of the short side of the recessed section.

Contact slip 30 made of resilient metal thin plate is formed of flat and circular ring-shaped frame section 30A and slope section 30B, which is formed by bending upward an inner portion of frame section 30A, and the underside of the tip of slope section 30B works as a contact. Frame section 30A of contact slip 30 is always placed on outside contact 26, and slope section 30B confronts center contact 25 with a given clearance maintained therebetween. The switch contact is thus formed.

Resilient unit 40 shaped like a cone with its bottom opened is placed on frame section 30A, and made of resilient material such as silicone rubber. Resilient unit 40 is regulated its horizontal position at its lower perimeter by a step section provided on the inner bottom face of housing 20, and a top face of its apex 41 forms a circular plane. A flaring section of resilient unit 40 is open downward and includes downward projection 42 placed on the underside of its ceiling, and downward projection 42 is positioned over slope section 30B of contact slip 30 with a given space maintained therebetween. Resilient unit 40 is not necessarily shaped like a cone, but it can be shaped like a pyramid.

Operating unit 50 made of resin includes operating section 53 projecting upward, and flange section 55 disposed at a lower part of operating section 53 projects laterally and horizontally. Flange section 55 is formed to fit into the recessed section of housing 20, namely, it forms typically a rectangle viewed from the top but the rectangle includes arcing concave section 56 on each short side for mating with the arcing guide projection 22. Flange section 55 also includes, at its four corners, regulatory projections 57 projecting downward and flush with flange section 55 along the inner wall of the recessed section of housing 20. A horizontal cross section of concave section 56 shows a similar figure to that of guide projection 22, and the clearance between concave section 56 and guide projection 22 is set small enough along the overall arcing shape.

Operating section 53 of operating unit 50 forms typically a rectangular parallelepiped, and lateral face 53A, namely, a short side viewed from the top, is formed of a face vertically rising from the position where arcing concave section 56 is recessed most inward. Another lateral face 53B, namely, a long side viewed from the top, is formed of a face slanting approx. 6° so that a space between two confronting faces 53B tapers upwardly. These slant faces 53B allow releasing each piece of operating units 50 from a mold with ease.

Operating unit 50 discussed above is placed on apex 41 of resilient unit 40 such that concave sections 56 can mate with guide projections 22, and flange section 55 as well as regulatory downward projections 57 disposed at the lower part of flange section 55 can be housed in the recessed section. Housing 20 includes guide bores 21, similar to the conventional one at each one of its four corners, formed in a shape corresponding to that of regulatory projections 57.

Cover 60 is placed on the top end of housing 20 and includes center hole 60A, from which operating section 53 of operating unit 50 extends upward, so that cover 60 is coupled to housing 20. The mating sections between guide projections 22 and concave sections 56 are covered with a flat section of cover 60, so that they are excellent in dust proof. Operating unit 50 receives upward energizing force from resilient unit 40 during a regular status (non-operating status) as shown in FIG. 1, so that the top face of flange section 55 is brought into contact with the underside of cover 60. This structure prevents operating unit 50 from wobbling.

The push switch in accordance with this exemplary embodiment is thus constructed, and its working will be demonstrated hereinafter.

Figure 7:
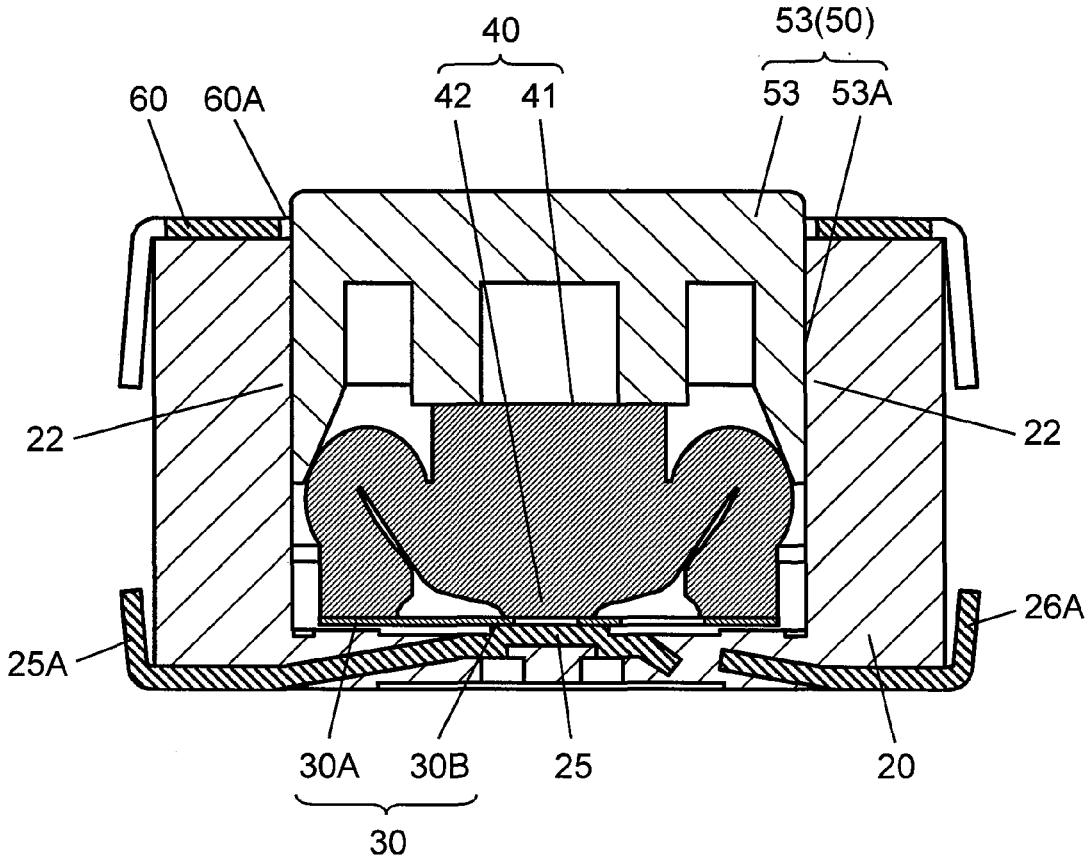
FIG. 7 shows a sectional view illustrating the push switch in operation.
Figure 8:
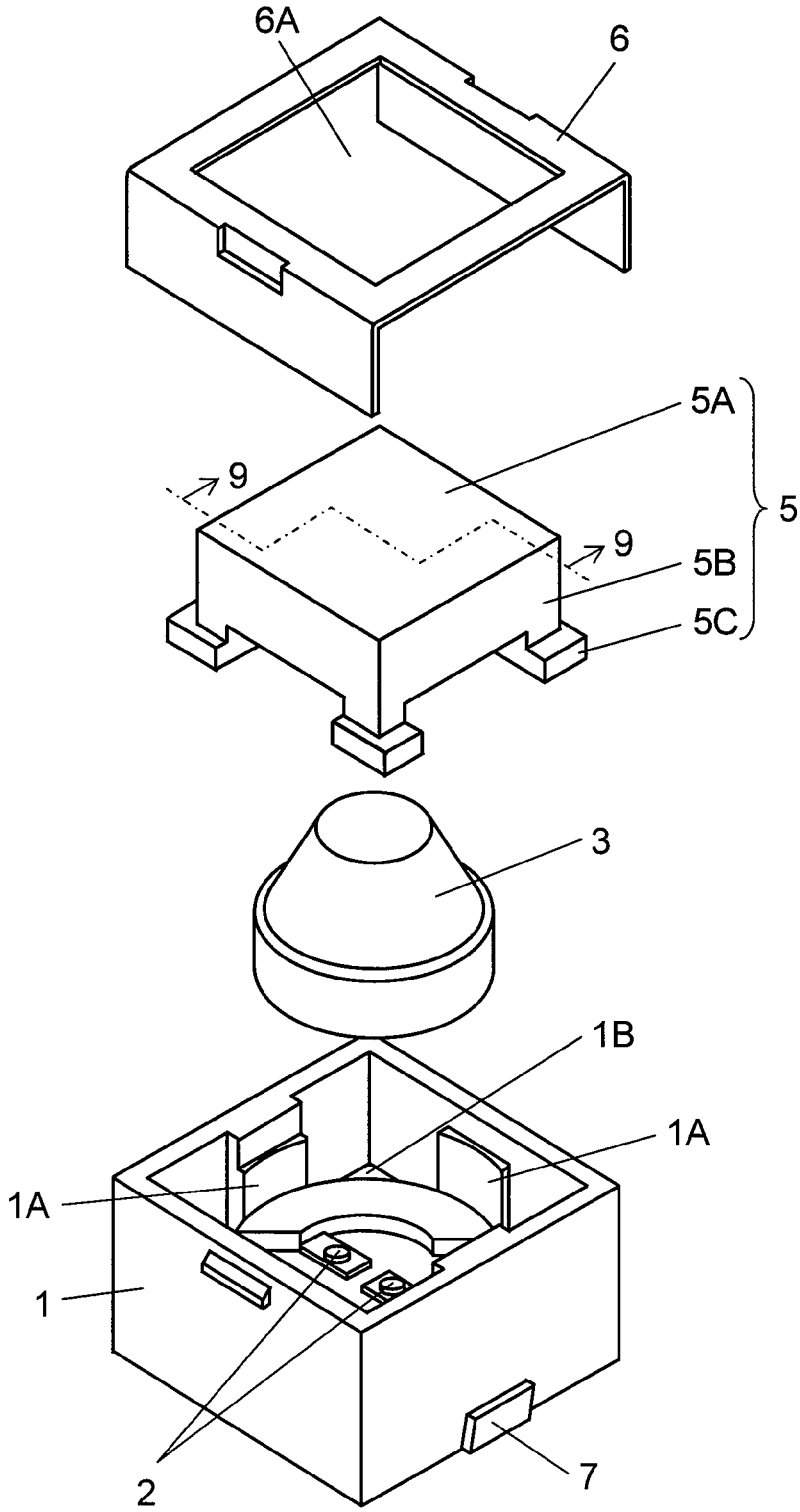
FIG. 8 PRIOR ART
FIG. 8 shows an exploded perspective view of a conventional push switch.
Figure 9:
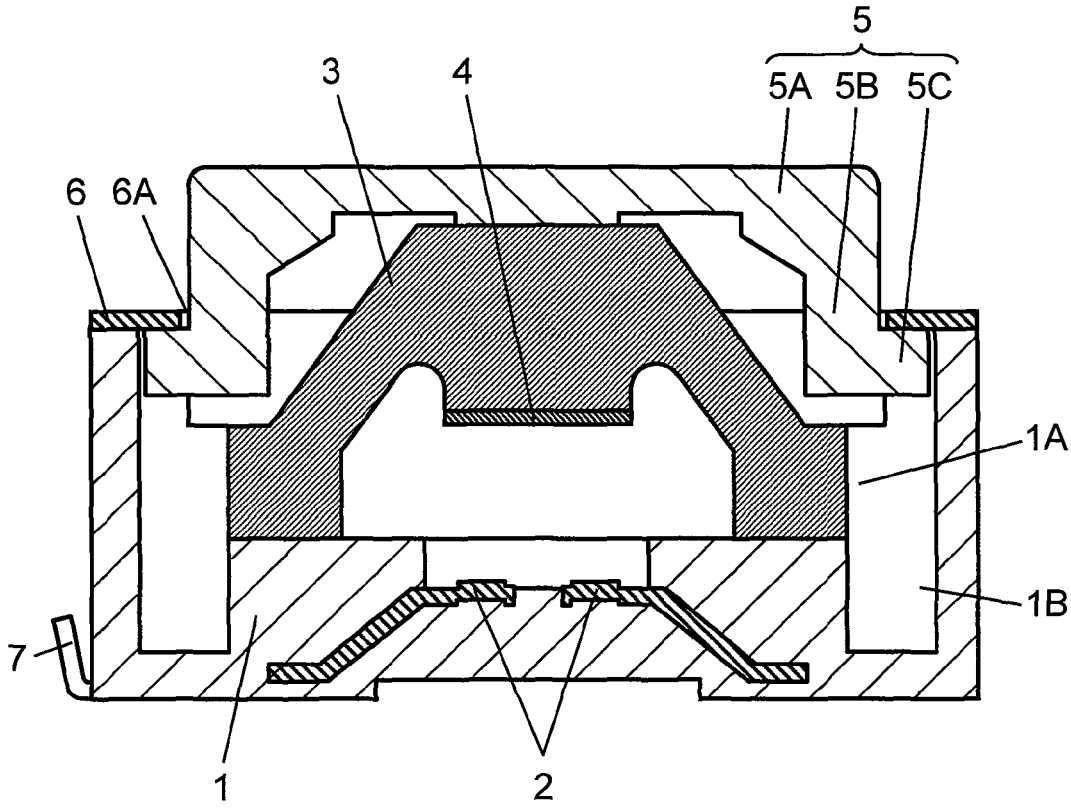
FIG. 9 PRIOR ART
FIG. 9 shows a sectional view cut along line 9-9 in FIG. 8.

Firstly, when operating unit 50 is depressed in the regular status (non-operating status) as shown in FIG. 1, concave section 56 is guided along guide projection 22, and operating unit 50 lowers while flange section 55 as well as the outer wall of regulatory projection 57 moves along the inner wall of the recessed section. Resilient unit 40 receives the depressing force at its apex 41, and when the depressing force exceeds a given level, the flaring section of resilient unit 40 is deformed resiliently with tactile feeling for depressing downward slope section 30B of contact slip 30 with its downward projection 42. The underside of the tip of slope section 30B is thus brought into contact with center contact 25, so that the push switch is turned on as shown in FIG. 7. As a result, terminals 25A and 25B extending outside supply an ON signal.

During the depressing operation discussed above, operating unit 50 moves downward while it is accompanied by the following movements: At the lower part of operating unit 50, concave section 56 is guided along guide projection 22 while flange section 55 as well as the outer wall of regulatory projection 57 moves along the inner wall of the recessed section. At the upper part of operating unit 50, operating section 53 moves downward while it is regulated by center hole 60A of cover 60, and each regulatory projection 57 is inserted into corresponding guide bore 21.

Since operating section 53 of operating unit 50 includes lateral face 53A, i.e. the short side viewed from the top of operating section 53, rising vertically from the position where concave section 56 is recessed most inward, lateral faces 53A on both side are still regulated their positions by guide projections 22 after concave section 56 travels. This mechanism prevents one of the short sides of operating unit 50 from slanting downward, so that operating unit 50 can avoid being jammed. As a result, operating unit 50 can move smoothly with a simple structure.

Removal of the operating force from the switch ON status discussed above will restore resilient unit 40 to the original shape, so that operating unit 50 is pushed up and slope section 30B of contact slip 30 also restores itself to the original shape. As a result, the push switch returns to the switch OFF status as shown in FIG. 1 where the tip of contact slip 30 is away from center contact 25. During this restoring operation, operating unit 50 returns upward while it is regulated by guide projections 22, similarly to the switch ON operation, at its lateral faces 53A and concave sections 56 of flange section 55 as same as the other sections, so that a smooth restoring operation can be expected.

The push switch in accordance with this embodiment thus allows a longer stroke and forms a slimmer body in a simple construction, and yet, it resists being jammed during the operation.

The mating shape of guide projection 22 with concave section 56 is not necessarily an arc shape in sectional view; however, it is important that guide projection 22 projects inside of housing 20, and an apex of projection 22 can still regulate lateral face 53A, which rises vertically from the position where concave section 56 is recessed most inward, of operating section 53 after concave section 56 travels. The sections to be regulated of operating unit 50 are not necessarily the sections formed on flat faces. The mating sections of operating unit 50 are preferably positioned at the center of the short side, because operating unit 50 can keep balance on the mating sections working as fulcrums.

A structure of the switch contact can be another form than the one discussed above, and an appearance of the housing is not necessarily a rectangular parallelepiped.

As discussed above, the push switch in accordance with the embodiment includes operating unit 50 which moves up and down while flange section 55 moves up and down along the inner wall of the recessed section of housing 20. After concave section 56 travels along guide projection 22, the vertical face of operating section 53 can be still regulated by guide projection 22. This vertical face rises from the position where concave section 56 is recessed most inward. The push switch in accordance with the embodiment, including the case where its appearance forms a slimmer body, allows reducing a frequency of incurring a jam of operating unit 50.

What is claimed is:

1. A push switch comprising:

a housing including an opening at a top and a recessed section at a lower part;

a push-type switch contact disposed on an inner bottom face of the recessed section;

an operating unit including an operating section at an upper part and a flange section at a lower part, the flange section having an upper surface;

a resilient unit disposed under the operating unit in the recessed section for energizing the operating unit upward; and a cover for covering the opening at the top and including a center hole from which the operating section extends upward, wherein the operating unit is movable up and down guided by a guide projection disposed on inner walls confronting each other of the recessed section and extending vertically on the inner walls and by a concave indentation provided in the flange section to mate with the guide projection, and wherein the operating section includes a sidewall extending from a top surface of the operating section to the upper surface of the flange section at a position directly above the concave indentation of the flange section.

2. The push switch of claim 1, wherein the upper surface of the flange section is brought into contact with an underside of the cover during a non-operating status of the operating section.

3. The push switch of claim 1, wherein the guide projection is disposed at a center of a short side wall of the recessed section.

4. The push switch of claim 1, wherein the guide projection shows an arc in a horizontal cross section.

5. The push switch of claim 1, wherein the flange section includes a regulatory projection projecting downward, and a depression of the operating section prompts the regulatory projection to mate with a guide bore disposed at a corner of the recessed section.

6. The push switch of claim 1, wherein the resilient unit includes a flat apex at an upper part and a flaring section at a lower part, and the flaring section is shaped like a cone or a pyramid of which bottom is open.

7. The push switch of claim 6, wherein a depression of the operating section with predetermined depressing force deforms the flaring section resiliently with tactile feeling.

8. The push switch of claim 6, wherein the resilient unit is regulated its horizontal position at its lower perimeter by a step section provided on the inner bottom face of the recessed section.

9. The push switch of claim 6, wherein the resilient unit includes a downward projection disposed on an underside of a ceiling of the flaring section for depressing the switch contact.

10. The push switch of claim 1, wherein the switch contact includes a center contact, an outside contact, both of the contacts are fixed to the inner bottom face of the recessed section, and a contact slip formed of resilient metal thin plate and including a frame section disposed on the outside contact, wherein the contact slip further includes a slope section which is brought into contact with the center contact by a depression of the operating section.

11. The push switch of claim 1, wherein no portion of the guide projection is located directly above the upper surface of the flange section.

12. The push switch of claim 1, wherein the position at which the sidewall extends to the upper surface of the flange section is a position where the concave indentation is recessed most inward.

* * * * *